US009788126B2

(12) United States Patent
Shennib et al.

(10) Patent No.: US 9,788,126 B2
(45) Date of Patent: Oct. 10, 2017

(54) CANAL HEARING DEVICE WITH ELONGATE FREQUENCY SHAPING SOUND CHANNEL

(71) Applicant: iHear Medical, Inc., San Leandro, CA (US)

(72) Inventors: Adnan Shennib, Oakland, CA (US); Victor Valenzuela, Hayward, CA (US)

(73) Assignee: iHear Medical, Inc., San Leandro, CA (US)

( * ) Notice: Subject to any disclaimer, the term of this patent is extended or adjusted under 35 U.S.C. 154(b) by 2 days.

(21) Appl. No.: 14/853,767

(22) Filed: Sep. 14, 2015

(65) Prior Publication Data

US 2016/0080872 A1 Mar. 17, 2016

Related U.S. Application Data

(60) Provisional application No. 62/050,663, filed on Sep. 15, 2014.

(51) Int. Cl.
*H04R 25/00* (2006.01)

(52) U.S. Cl.
CPC ..... *H04R 25/48* (2013.01); *H04R 25/602* (2013.01); *H04R 25/608* (2013.01); *H04R 25/456* (2013.01); *H04R 25/654* (2013.01); *H04R 2225/025* (2013.01); *H04R 2225/31* (2013.01)

(58) Field of Classification Search
CPC ..... H04R 25/02; H04R 25/456; H04R 25/48; H04R 25/60; H04R 25/602; H04R 25/608; H04R 25/654; H04R 2225/025; H04R 2225/31
See application file for complete search history.

(56) References Cited

U.S. PATENT DOCUMENTS 4,759,070 A 7/1988 Voroba
4,962,537 A * 10/1990 Basel ..... H04R 25/656 381/324
5,197,332 A 3/1993 Shennib
5,327,500 A 7/1994 Campbell
(Continued)

FOREIGN PATENT DOCUMENTS

JP 2008109594 A 5/2008
KR 1020050114861 A 12/2005
(Continued)

OTHER PUBLICATIONS

International Search and Written Opinion received for PCT US/2015/050023 dated Dec. 22, 2015.
(Continued)

*Primary Examiner* — Joshua Kaufman
(74) *Attorney, Agent, or Firm* — Dorsey & Whitney LLP

(57) ABSTRACT

Examples of canal hearing devices including a lateral section having a frequency shaping sound port system are disclosed. A lateral section includes an elongate sound channel for receiving an incoming sound and producing a frequency-shaped sound output. The hearing device includes a microphone, a speaker for transmitting sound to the eardrum, and a sound port to receive the frequency-shaped sound output from the elongate sound channel and provide a pathway for the frequency-shaped sound output to reach the microphone.

34 Claims, 9 Drawing Sheets

(56) References Cited

U.S. PATENT DOCUMENTS 5,553,152 A 9/1996 Newton
5,645,074 A 7/1997 Shennib et al.
5,659,621 A 8/1997 Newton
5,701,348 A 12/1997 Shennib et al.
5,785,661 A 7/1998 Shennib et al.
6,137,889 A 10/2000 Shennib et al.
6,212,283 B1 4/2001 Fletcher et al.
6,319,207 B1 11/2001 Naidoo
6,359,993 B2 3/2002 Brimhall
6,367,578 B1 4/2002 Shoemaker
6,379,314 B1 4/2002 Horn
6,382,346 B2 5/2002 Brimhall et al.
6,428,485 B1 8/2002 Rho
6,447,461 B1 9/2002 Eldon
6,473,513 B1 10/2002 Shennib et al.
6,522,988 B1 2/2003 Hou
6,546,108 B1 4/2003 Shennib et al.
6,674,862 B1 1/2004 Magilen
6,724,902 B1 4/2004 Shennib et al.
6,840,908 B2 1/2005 Edwards et al.
6,937,735 B2 8/2005 DeRoo et al.
6,940,988 B1 9/2005 Shennib et al.
6,978,155 B2 12/2005 Berg
7,010,137 B1 3/2006 Leedom et al.
7,016,511 B1 3/2006 Shennib
7,037,274 B2 5/2006 Thoraton et al.
7,113,611 B2 9/2006 Leedom et al.
7,215,789 B2 5/2007 Shennib et al.
7,260,232 B2 8/2007 Shennib
7,298,857 B2 11/2007 Shennib et al.
7,310,426 B2 12/2007 Shennib et al.
7,321,663 B2 1/2008 Olsen
7,403,629 B1 7/2008 Aceti et al.
7,424,123 B2 9/2008 Shennib et al.
7,424,124 B2 9/2008 Shennib et al.
7,580,537 B2 8/2009 Urso et al.
7,664,282 B2 2/2010 Urso et al.
7,854,704 B2 12/2010 Givens et al.
7,945,065 B2 5/2011 Menzl et al.
8,073,170 B2 12/2011 Kondo et al.
8,077,890 B2 12/2011 Schumaier
8,155,361 B2 4/2012 Schindler
8,184,842 B2 5/2012 Howard et al.
8,243,972 B2 8/2012 Latzel
8,284,968 B2 10/2012 Schumaier
8,287,462 B2 10/2012 Givens et al.
8,340,335 B1 * 12/2012 Shennib ..... H04R 25/60 381/315
8,379,871 B2 2/2013 Michael et al.
8,396,237 B2 3/2013 Schumaier
8,447,042 B2 5/2013 Gurin
8,467,556 B2 * 6/2013 Shennib ..... H04R 25/02 381/323
8,503,703 B2 8/2013 Eaton et al.
8,571,247 B1 10/2013 Oezer
8,718,306 B2 5/2014 Gommel et al.
8,798,301 B2 8/2014 Shennib
8,855,345 B2 * 10/2014 Shennib ..... H04R 25/602 381/322
9,031,247 B2 5/2015 Shennib
9,060,233 B2 6/2015 Shennib et al.
9,078,075 B2 7/2015 Shennib et al.
9,107,016 B2 8/2015 Shennib
9,439,008 B2 9/2016 Shennib
2001/0008560 A1 7/2001 Stonikas et al.
2001/0009019 A1 7/2001 Armitage
2001/0040973 A1 * 11/2001 Fritz ..... A61B 5/6817 381/322
2002/0027996 A1 3/2002 Leedom et al.
2002/0085728 A1 7/2002 Shennib et al.
2003/0007647 A1 1/2003 Nielsen et al.
2003/0078515 A1 4/2003 Menzel et al.
2004/0028250 A1 2/2004 Shim
2004/0073136 A1 4/2004 Thornton et al.
2004/0165742 A1 8/2004 Shennib et al.
2005/0094822 A1 5/2005 Swartz
2005/0190938 A1 9/2005 Shennib et al.
2005/0226447 A1 10/2005 Miller, III
2005/0245991 A1 11/2005 Faltys et al.
2005/0249370 A1 11/2005 Shennib et al.
2005/0259840 A1 11/2005 Gable et al.
2005/0283263 A1 12/2005 Eaton et al.
2006/0094981 A1 5/2006 Camp
2006/0210104 A1 9/2006 Shennib et al.
2006/0291683 A1 12/2006 Urso et al.
2007/0071252 A1 * 3/2007 Burger ..... H04R 25/48 381/91
2007/0071265 A1 3/2007 Leedom et al.
2007/0076909 A1 4/2007 Roeck et al.
2007/0189545 A1 8/2007 Geiger et al.
2007/0237346 A1 10/2007 Fichtl et al.
2008/0137891 A1 * 6/2008 Vohringer ..... H04R 25/602 381/328
2008/0240452 A1 10/2008 Burrows et al.
2008/0273726 A1 11/2008 Yoo et al.
2010/0040250 A1 2/2010 Gebert
2010/0119094 A1 5/2010 Sjursen et al.
2010/0145411 A1 6/2010 Spitzer
2010/0226520 A1 9/2010 Feeley et al.
2010/0239112 A1 9/2010 Howard et al.
2010/0268115 A1 10/2010 Wasden et al.
2010/0284556 A1 11/2010 Young
2011/0058697 A1 3/2011 Shennib et al.
2011/0176686 A1 7/2011 Zaccaria
2011/0188689 A1 8/2011 Beck et al.
2011/0190658 A1 8/2011 Sohn et al.
2011/0200216 A1 8/2011 Lee et al.
2011/0206225 A1 8/2011 Møller et al.
2012/0051569 A1 3/2012 Blamey et al.
2012/0095528 A1 4/2012 Miller, III et al.
2012/0130271 A1 5/2012 Margolis et al.
2012/0177212 A1 7/2012 Hou et al.
2012/0177235 A1 7/2012 Solum
2012/0183164 A1 7/2012 Foo et al.
2012/0183165 A1 7/2012 Foo et al.
2012/0189140 A1 7/2012 Hughes
2012/0213393 A1 8/2012 Foo et al.
2012/0215532 A1 8/2012 Foo et al.
2012/0263330 A1 * 10/2012 Larsen ..... H04R 1/245 381/322
2012/0285470 A9 11/2012 Sather et al.
2012/0302859 A1 11/2012 Keefe
2013/0010406 A1 1/2013 Stanley
2013/0177188 A1 7/2013 Apfel et al.
2013/0182877 A1 7/2013 Angst et al.
2013/0223666 A1 8/2013 Michel et al.
2013/0243209 A1 9/2013 Zurbruegg et al.
2013/0243227 A1 9/2013 Kinsbergen et al.
2013/0243229 A1 9/2013 Shennib et al.
2013/0294631 A1 11/2013 Shennib et al.
2014/0003639 A1 1/2014 Shennib et al.
2014/0150234 A1 6/2014 Shennib et al.
2014/0153761 A1 6/2014 Shennib et al.
2014/0153762 A1 6/2014 Shennib et al.
2014/0254843 A1 9/2014 Shennib
2014/0254844 A1 9/2014 Shennib
2015/0023512 A1 1/2015 Shennib
2015/0023534 A1 1/2015 Shennib
2015/0023535 A1 1/2015 Shennib
2015/0025413 A1 1/2015 Shennib
2015/0215714 A1 7/2015 Shennib
2015/0256942 A1 9/2015 Kinsbergen et al.
2016/0337770 A1 11/2016 Shennib

FOREIGN PATENT DOCUMENTS

KR 100955033 B1 4/2010
KR 1020100042370 A 4/2010
WO 99/07182 A2 2/1999
WO 2010/091480 A1 8/2010
WO 2011128462 A2 10/2011
WO 2015009559 A1 1/2015

(56) References Cited

FOREIGN PATENT DOCUMENTS

| | | | |
|---|---|---|---|
| WO | 2015009561 | A1 | 1/2015 |
| WO | 2015009564 | A1 | 1/2015 |
| WO | 2015009569 | A1 | 1/2015 |

OTHER PUBLICATIONS

"Basic Guide to In Ear Canalphones", Internet Archive, Head-Fi.org, Jul. 1, 2012. Retrieved from http://web.archive.org/web/20120701013243/http:www.head-fi.org/a/basic-guide-to-in-ear-canalphones> on Apr. 14, 2015.

"dB HL—Sensitivity to Sound—Clinical Audiograms", Internet Archive, AuditoryNeuroscience.com, Apr. 20, 2013. Retrieved from <https://web.archive.org/web/20130420060438/http://www.auditoryneuroschience.com/acoustics/clinical_audiograms>on Apr. 14, 2015.

"Lyric User Guide", http://www.phonak.com/content/dam/phonak/b2b/C_M_tools/Hearing_Instruments/Lyric/documents/02-gb./Userguide_Lyric_V8_GB_FINAL_WEB.pdf, Jul. 2010.

"Methods for Calculation of the Speech Intelligibility Index", American National Standards Institute, Jun. 6, 1997.

"Specification for Audiometers", American National Standards Institute, Nov. 2, 2010.

"The Audiogram", Internet Archive, ASHA.org, Jun. 21, 2012. Retrieved from <https:/web.archive.org/web/20120621202942/http://www.asha.org/public/hearing/Audiogram> on Apr. 14, 2015.

"User Manual—2011", AMP Personal Audio Amplifiers.

Abrams, "A Patient-adjusted Fine-tuning Approach for Optimizing the Hearing Aid Response", The Hearing Review, Mar. 24, 2011, 1-8.

Amlani, et al., "Methods and Applications of the Audibility Index in Hearing Aid Selection and Fitting", Trends in Amplication 6.3 (2002) 81. Retrieved from <https://www.ncbi.nim.nih.gov/pmc/articles/PMC4168961/> on Apr. 14, 2015.

ASHA, "Type, Degree, and Configuration of Hearing Loss", American Speech-Language-Hearing Association; Audiology Information Series, May 2011, 1-2.

Convery, et al., "A Self-Fitting Hearing Aid: Need and Concept", http://tia.sagepubl.com, Dec. 4, 2011, 1-10.

Franks, , "Hearing Measurements", National Institute for Occupational Safety and Health, Jun. 2006, 183-232.

Kiessling, , "Hearing aid fitting procedures—state-of-the-art and current issues", Scandinavian Audiology vol. 30, Suppl 52, 2001, 57-59.

Nhanes, , "Audiometry Procedures Manual", National Health and Nutrition Examination Survey, Jan. 2003, 1-105.

Traynor, , "Prescriptive Procedures", www.rehab.research.va.gov/mono/ear/traynor.htm, Jan. 1999, 1-16.

World Health Organization, , "Deafness and Hearing Loss", www.who.int/mediacentre/factsheets/fs300/en/index.html, Feb. 2013, 1-5.

* cited by examiner

*Battery Module – Baseline vs. with Sound Channel*

CANAL HEARING DEVICE WITH ELONGATE FREQUENCY SHAPING SOUND CHANNEL

CROSS-REFERENCE TO RELATED APPLICATIONS

This application claims the benefit under 35 U.S.C. 119 of the earlier filing date of U.S. Provisional Application No. 62/050,663, entitled "CANAL HEARING DEVICE WITH ELONGATE FREQUENCY SHAPING SOUND CHANNEL," filed Sep. 15, 2014. The aforementioned provisional application is hereby incorporated by reference in its entirety, for any purpose.

This application is related to U.S. Pat. No. 8,467,556, titled, "CANAL HEARING DEVICE WITH DISPOSABLE BATTERY MODULE," U.S. Pat. No. 8,855,345, titled, "BATTERY MODULE FOR PERPENDICULAR DOCKING INTO A CANAL HEARING DEVICE," U.S. Pat. No. 8,798,301, titled, "TOOL FOR REMOVAL OF CANAL HEARING DEVICE FROM EAR CANAL," U.S. Pat. No. 9,078,075, titled, "TOOL FOR INSERTION OF CANAL HEARING DEVICE INTO THE EAR CANAL," and U.S. Pat. No. 9,060,233, titled, "RECHARGEABLE CANAL HEARING DEVICE AND SYSTEMS;" all of which are incorporated herein by reference in their entirety for any purpose.

TECHNICAL FIELD

Examples described herein relate to hearing devices and more particularly a canal hearing device including a lateral section having a frequency shaping sound port system.

BACKGROUND

Placement of a hearing device inside the ear canal is generally desirable for various electroacoustic advantages such as reduction of the acoustic occlusion effect, improved energy efficiency, reduced distortion, reduced receiver vibrations, and improved high frequency response. Placement inside the ear canal may also be desirable for cosmetic reasons, with many of the hearing impaired preferring to wear inconspicuous hearing devices. A canal hearing device can be inserted entirely or partially inside the ear canal.

The ear canal is a hostile environment for hearing devices inserted within. Earwax and debris often plugs sound ports, and even migrates inside the hearing device causing damage to sensitive components inside, particularly the electronics and transducers, e.g., the microphone and receiver, inside. The transducers of conventional hearing devices typically degrade in audio characteristics over time from debris such as earwax and moisture. In order to combat the hostile environment of the ear canal, conventional hearing devices typically include a barrier for the protection of transducers from ear canal debris. Permanent and disposable barriers and filters are often used in conventional hearing devices. These types of barriers eventually become overwhelmed by the debris in the ear canal, which causes plugging of the sound ports or damage to components of the hearing device from debris ingress. Damage by debris is common in canal hearing devices, particularly in CIC types, because of the depth of insertion into the ear canal and the severity of the environment therein.

SUMMARY

A canal hearing device may include a lateral section and a main section. The lateral section may be integrated with the main section or modular. The lateral section may include a housing configured to accommodate a battery cell at least partially within. The housing may include an elongate sound channel configured to receive an incoming sound from a sound channel inlet and provide a frequency-shaped sound output at a sound channel outlet. The elongate sound channel may be formed at least partially by an inner surface of the housing. The elongate sound channel may be formed at least partially formed by an outer surface of the battery cell.

The incoming sound inlet may be positioned lateral to the battery cell. The sound channel outlet may be positioned medial to the battery cell. In some examples, the lateral section may include a handle on a lateral end of the housing. In some examples, the sound channel inlet may be incorporated within the handle. The elongate sound channel may be configured to produce at least a 3 dB boost at a frequency within the range of 3-6 kHz.

An air tab may be at least partially inserted within the elongate sound channel, wherein the air tab is attached to the battery cell blocking an air inlet of the battery cell. In some examples, a debris barrier may be coupled to the elongate sound channel. The debris barrier may include alternating microstructures. In some examples, the elongate sound channel may include any of hydrophobic, oleophobic, and oleophilic properties.

The main section may include a microphone, a speaker, and a sound port. The speaker may transmit sound to the eardrum. The sound port may acoustically couple the frequency-shaped sound output to the microphone. The lateral section may be at least partially disengageable from the main section.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof, including the best mode presently contemplated of practicing the invention, when taken in conjunction with the accompanying drawings, in which.

DETAILED DESCRIPTION

Certain details are set forth below to provide a sufficient understanding of embodiments of the invention. Some embodiments, however, may not include all details described. In some instances, well known structures may not be shown in order to avoid unnecessarily obscuring the described embodiments of the invention. A canal hearing device according to examples disclosed herein refers to any hearing device with sound delivery inside the ear canal, whether partially or fully inserted therein. This may include Completely-In-the-Canal (CIC), In-The-Canal (ITC), invisible extended wear deep canal, as well as Receiver-In-the-Canal (RIC) devices.

Figure 2:
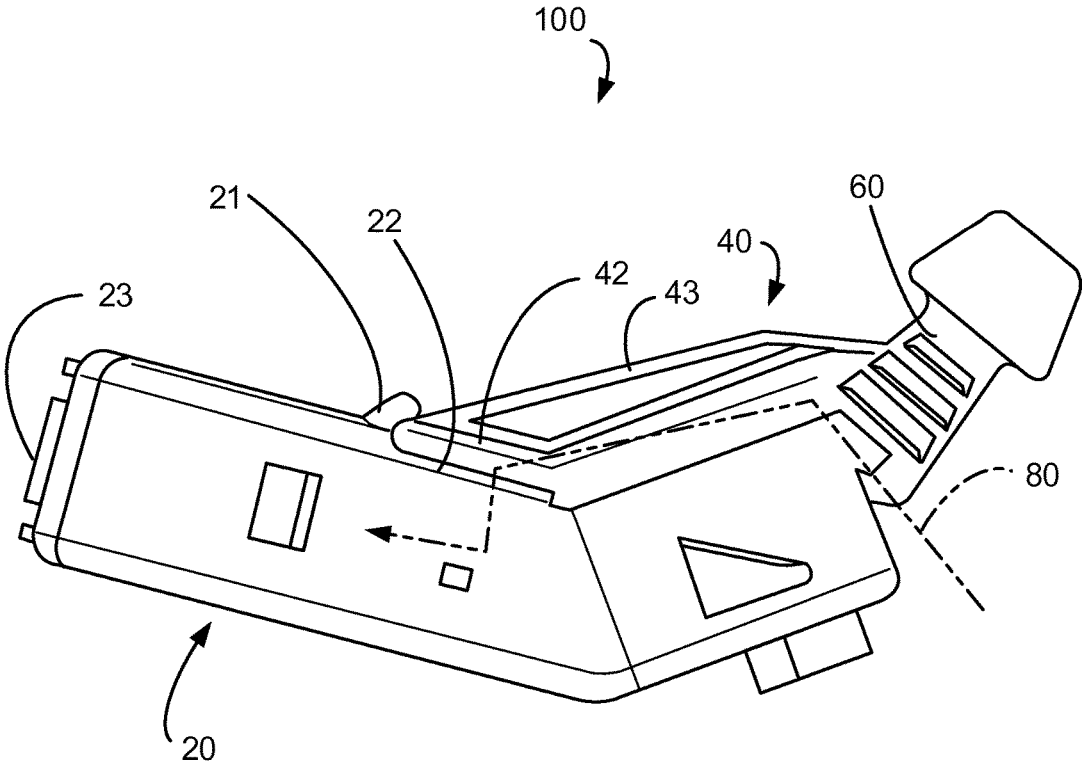
FIG. 2 is a side view of a canal hearing device showing a sound path through an elongate sound channel within the lateral section of the canal hearing device, according to some examples.

The present disclosure describes examples of canal hearing devices including a frequency shaping sound port system. The sound port system may be provided in a lateral section 40 of a canal hearing device, for example the canal hearing device 100 illustrated in FIG. 2, which may also be referred to herein as canal hearing device assembly. The lateral section 40 of canal hearing device 100 may include a housing 43 configured to accommodate a battery cell 41 at least partially within. The lateral section 40 may be coupled to a main section 20 to form the canal hearing device 100, e.g., as shown in FIG. 2. The housing 43 of the lateral section 40 may include a sound channel 50, which may be an elongate sound channel. The sound channel 50 may be configured to receive an incoming sound and produce a frequency-shaped sound output. The sound channel 50 may provide a pathway (e.g., sound path 80 in FIG. 2) for sounds to travel to a microphone 71 of the main section 20. In some examples, the sound channel 50 may provide a non-linear sound path between a sound channel inlet 51 and a sound channel outlet 53 of the sound channel 50. The non-linear sound path may be a curved sound path or a tortuous sound path, which may increase the acoustic isolation between the sound channel inlet 51 and the speaker outlet 23 thereby minimizing feedback.

The canal hearing device 100 may be disengageable or an integrated assembly. In some examples, the lateral section may be integrated with the main section 20. In some examples, the lateral section 40 may be modular. The lateral section 40 may also be referred to as lateral module 40. The lateral module 40 may be coupled to a modular main section 20, which may also be referred to as main module 20, to form a modular canal hearing device 100. Partial disengagement may provide the canal hearing device 100 in an OFF condition. In some examples, the lateral module 40 may be removably coupled to the main module 20. Decoupling or at least partially disengaging the lateral module 40 from the main module 20 may partially or fully electrically decouple the lateral module 40 from the main module 20. By electrically decoupling the lateral module 40 from the main module 20, battery usage may be reduced. Engagement between the main module 20 and lateral module 40 may provide the canal hearing device 100 in an ON condition. Engagement between the main module 20 and the lateral module 40 may include electrically, mechanically, and acoustically coupling the lateral module 20 to the main module 40. In some examples, the lateral module 20 may be disengaged from the main module 40, e.g., for replacement of a battery cell 41.

Figure 1:
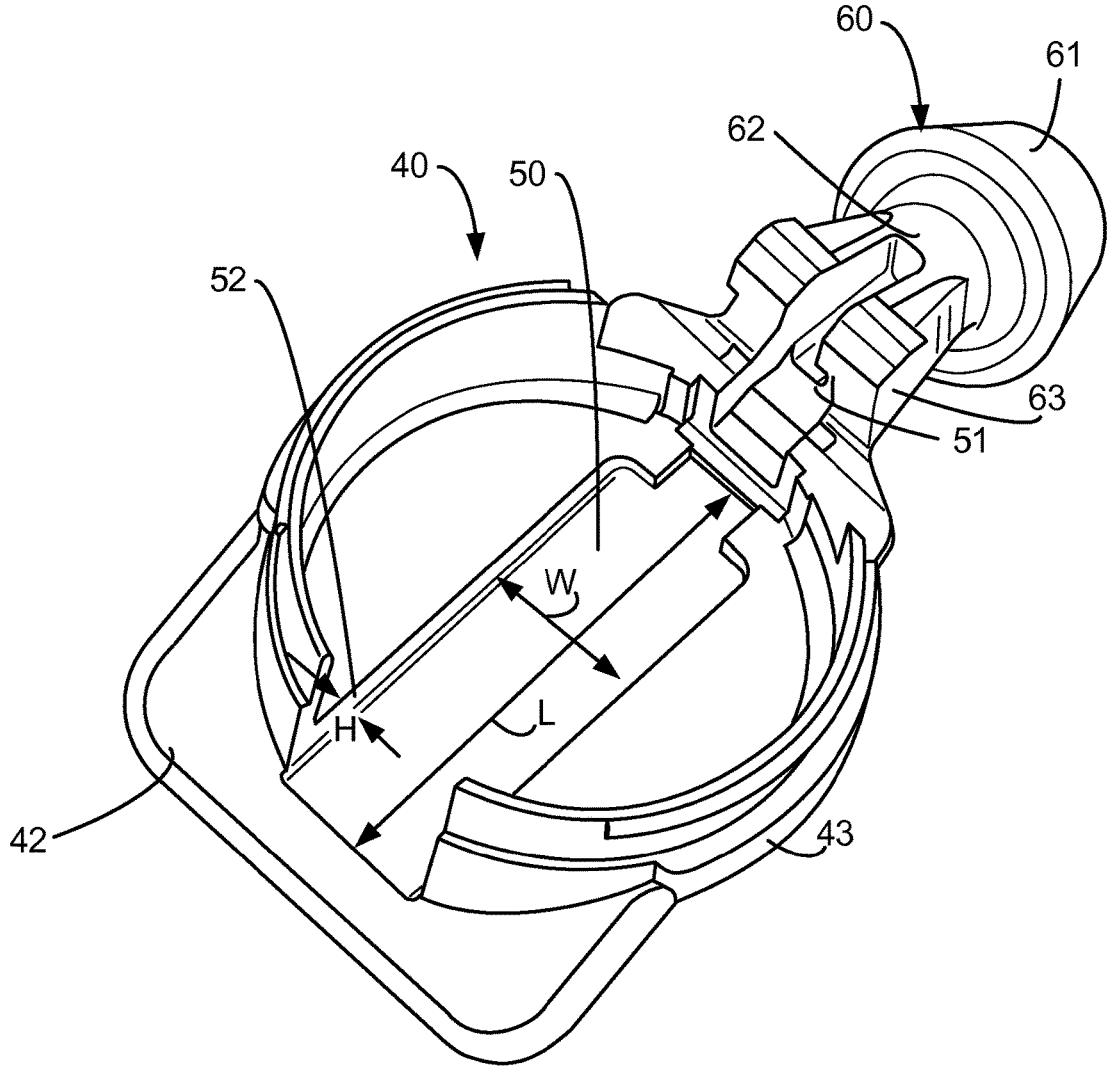
FIG. 1 is an isometric view of a lateral section of a canal hearing device, showing an elongate sound channel, according to some examples.

FIG. 1 is an isometric view of a lateral section 40 of a canal hearing device 100, according to some examples. A canal hearing device 100 assembly according to the examples herein may be inconspicuous and transmits amplified sound inside the ear canal. In some examples, the canal hearing device 100 may be modular and may include a main module 20 and a lateral module 40 removably coupled thereto. The lateral section 40 may include a housing 43 for accommodating a battery cell 41 at least partially within. In some examples, the battery cell 41 is integrated within the lateral section 40, which may generally imply that the battery cell 41 is not intended to be decoupled from the lateral section 40 by the user (e.g., the battery cell 41 is non-removably coupled to the lateral section 40). In such examples, the battery cell 41 and lateral section 40 may be disposable. In some examples, the battery cell 41 may be integrated within the lateral section 40 and may be rechargeable while the battery cell 41 remains attached to the lateral section 40.

The housing 43 of the lateral section 40 of the canal hearing device 100 may include a sound channel 50, which may be an elongate sound channel. The sound channel 50 may be configured to receive an incoming sound and producing a frequency-shaped sound output. Walls of the sound channel 50 may be formed by inner surfaces of the lateral section 40. The walls may include side walls 52, which may vary in height along a longitudinal axis of the lateral section 40. The side walls 52 may increase in height (H) medially and may accordingly also be referred to herein as sloped walls 52. A sound channel having sloped walls may be generally wedge-shaped or horn-shaped. The width (W) of the elongate sound channel 50 may remain constant along the length (L) of the elongate sound channel 50. In some examples, the width (W) may vary as may be desired to produce predetermined sound characteristics. The sound channel 50 may include an inlet (e.g., sound channel inlet 51). Incoming sound from outside the ear may enter the sound channel 50 through the sound channel inlet 51, which may also be referred to as incoming sound inlet. The incoming sound channel inlet 51 may be positioned lateral to the battery cell 41 or lateral to a cavity within the housing configured to at least partially accommodate the battery cell therein. The sound channel 50 may include an outlet (e.g., sound channel outlet 53), which may acoustically couple the sound channel 50 to the main module 40 when the lateral module 20 is coupled thereto.

The housing 43 may be formed from plastic. A handle 60 may be provided on a lateral end of the housing 43. The handle 60 may include a shaft 62 and a knob 61. In some examples, the incoming sound channel inlet 51 may be incorporated within the handle 60. In some examples, the incoming sound inlet may be incorporated within a base 63 of the handle 60 or proximate thereto. The handle 60 may include a conduit for air and/or sound waves to pass from the incoming sound channel inlet 51 into the elongate sound channel 50. In some examples, the incoming sound channel inlet 51 may be incorporated within a lateral end of the canal hearing device 100. A flange cap 42 may be provided on a medial end of the housing 43. The flange cap 42 may extend outwardly beyond the sound channel 50 and may thereby facilitate acoustically coupling of the sound channel 50 with the microphone 71 provided in the main section 20. The flange cap 42 may couple to a lip 21 of the main section 20 for acoustic coupling of the main section 20 and lateral section 40.

In some examples, the lateral section 40 may be generally cylindrical in shape and configured to enclose a portion of the battery cell 41. Other form factors may be used, however it will be appreciated that by substantially conforming to the shape of the battery cell 41 and other components within, the overall size of the canal hearing device 100 may be reduced. In some examples, the lateral section 40 may include a cavity for receiving the battery cell 41 therein. The sound channel 50 may be formed in a surface (e.g., an inner surface) of the cavity with the sound channel inlet 51 positioned laterally to the cavity.

In some examples, the lateral section 40 may be implemented for generally perpendicular insertion and removal, into and from the main section 20 forming a canal hearing device assembly 100 when joined thereto. Perpendicular joining of the lateral section 40 and circumferential encapsulation by the main section 20 may reduce or eliminate the risk of inadvertent separation of the lateral section 40 during axial movements of the canal hearing device 100 inside the ear, for example during insertion or removal of the canal hearing device 100 into and from the ear canal. The lateral section 40 may be removed from the main section 20 by applying a generally perpendicular force away from the main section 20. Partial removal of the lateral section 40 may also be provided for maintaining an OFF position (also referred to as an OFF power position) while keeping the sections together. In some examples, a disengagement, removal and/or insertion tool may be provided for users, particularly those with limited dexterity. Tools for disengagement, removal and/or insertion of the canal hearing device or for installation or removal of the lateral section 40 of the canal hearing device 100 may be implemented according to the examples in U.S. Pat. Nos. 8,798,301, 9,060,233 and 9,078,075, which are incorporated herein in their entirety for any purpose.

FIG. 2 is a side view of a canal hearing device 100 showing a sound path 80 provided by the lateral section 40 of the canal hearing device 100, according to some examples. The main section 20 may fit safely in the ear canal and may incorporate durable components intended for long-term use. The durable components of the main section 20 may include a microphone 71, a speaker 73 for generating sound, and a speaker outlet 23 which may be acoustically coupled to the speaker 73 to provide amplified sound to into the ear canal. The lateral section 40 may be electrically and mechanically disengageable from the main section 20. In some examples, the lateral section 40 may be configured for partial disengagement from the main section 20. The main section 20 may include a lip 21 to secure the lateral section 40 when coupled thereto. The lip 21 may couple to the flange cap 42 of the lateral section 40 for secure engagement.

The elongate sound channel 50 may provide air access to the battery cell 41 housed within the lateral section 40. Metal-air batteries known in the art, such as zinc-air batteries for example, generally require a flow of air/oxygen to the interior of the battery cell 41 to effect the chemical reaction within. In some examples, the sound channel 50 is partially formed by a surface of the battery cell 41. An air inlet of the battery cell 41 (which may also be referred to as an air hole or an air aperture) may be provided on the surface of the battery cell 41, which forms, in part, the sound channel 50. As such, the sound port system described herein may simultaneously serve the purpose of allowing sound waves to be transmitted to the microphone 71 and air/oxygen to reach the battery cell 41. In some examples, the battery cell 41 may be a rechargeable type, and may not require an air aperture. In some examples, the air inlet of the battery cell 41 may comprise a plurality of micro apertures.

Figure 3:
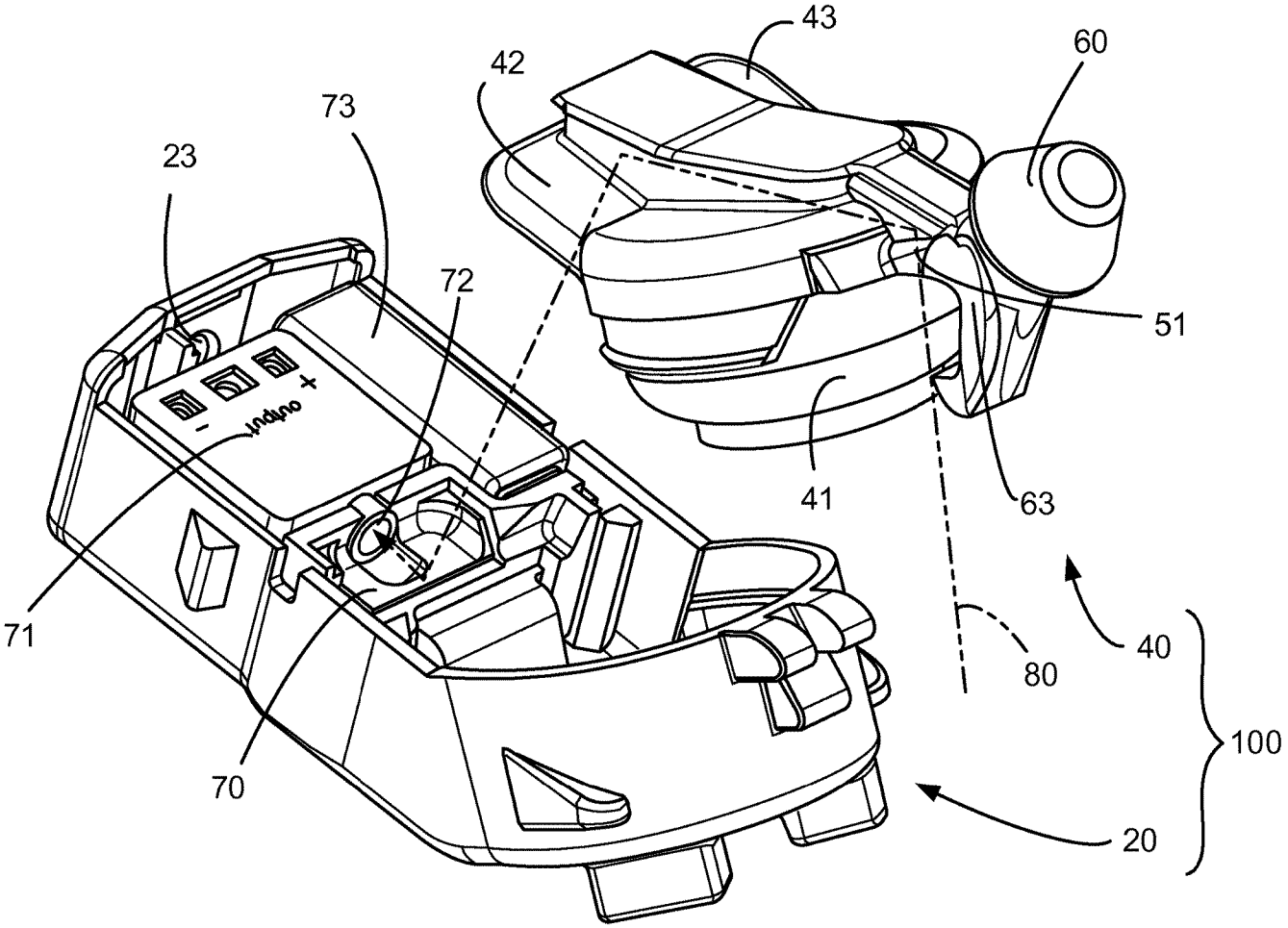
FIG. 3 is sectional view of a sound path through a lateral section, a manifold, and into a microphone of a canal hearing device, according to some examples.

FIG. 3 is an exploded view of the canal hearing device 100 according to some examples. The canal hearing device 100 may include a sound port system, which may be provided, at least partially, in the lateral section 40. The sound port system may allow sound to be transmitted to the microphone 71 provided in the main section 20 while providing frequency shaping for incoming sound. The sound port system may also mitigate debris ingress into the microphone 71, which is a major problem in conventional hearing aid design. The sound port system may include an elongate sound channel 50 and an incoming sound channel inlet 51. In some examples, the incoming sound channel inlet 51 may be positioned lateral to a battery cell 41. Incoming sound ports of conventional hearing aids frequently get soiled and clogged by debris. In some examples, the lateral section 40 is disposable thus replaced with a new sound channel and incoming sound channel inlet 51 upon replacement of the lateral section 40. As previously described, the main section 20 may include a microphone 71 for receiving sound from outside of the ear and communicating digital signals to the speaker 73 for providing amplified sound to the ear canal of the user. The canal hearing device 100 may include a sound port, for example a manifold 70, which may be provided in the main section 20. The manifold 70 may acoustically couple the outlet of the sound channel 50 to a microphone port 72 of the microphone 71.

Figure 4:
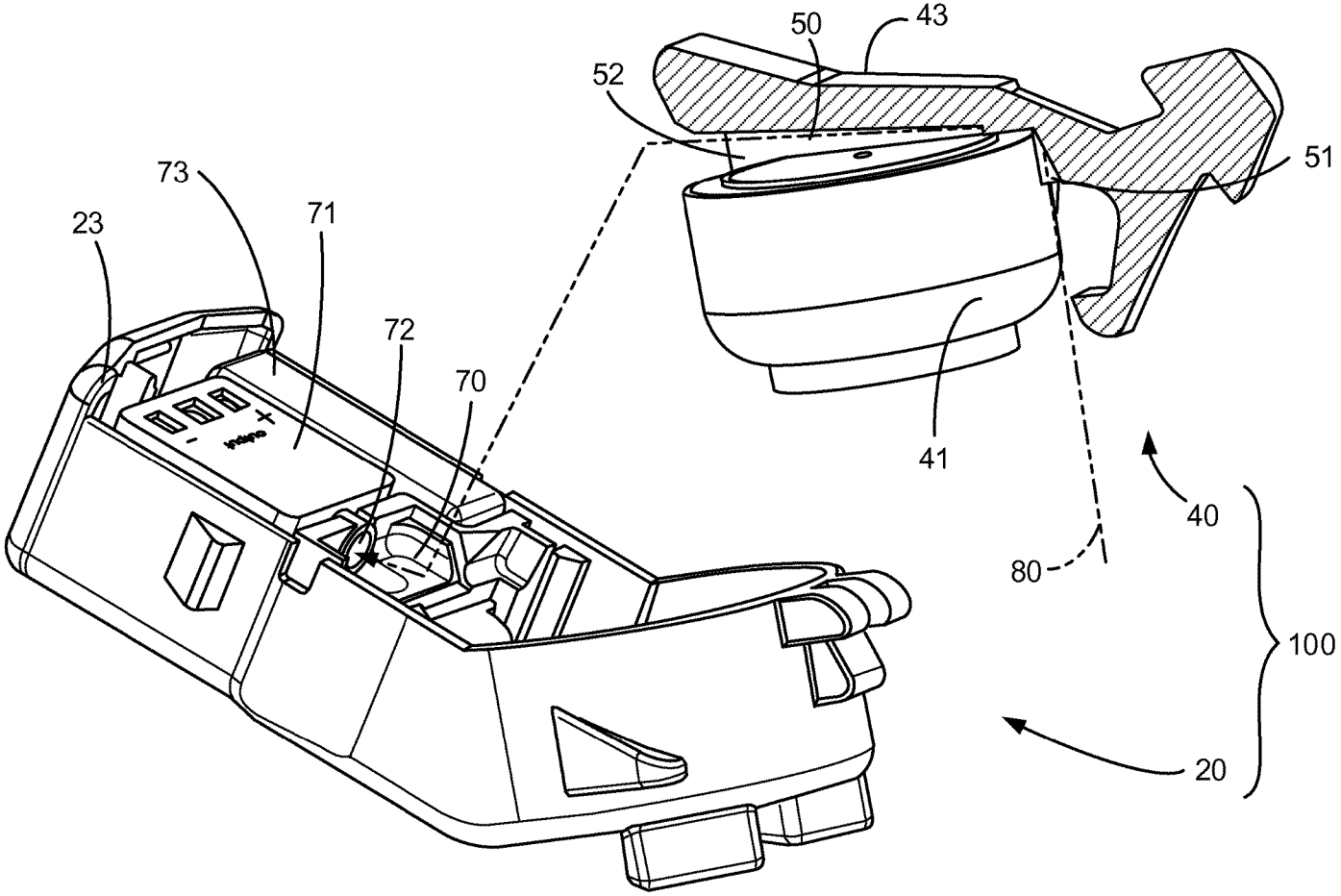
FIG. 4 is a sectional view of FIG. 3 showing a sound path through an elongate sound channel incorporated within a housing of the lateral section and into the microphone port, according to some examples.

FIG. 4 is a sectional view of FIG. 3 showing a sound path through an elongate sound channel 50 incorporated within a housing 43 of the lateral section 40, according to some examples. The sound port system of the lateral section 40 may be configured to receive sound from the incoming sound channel inlet 51. The sound port system may be configured to transport the sounds through the elongate sound channel 50. The sound port system may provide a pathway for the air conducted sounds to travel to the microphone 71 within the main section 20. At least a portion of the elongate sound channel 50 may be incorporated into the housing 43 of the lateral section 40. In some examples, at least one of the walls of the elongate sound channel 50 may be formed by an inner surface of the housing 43. In some examples, at least one of the walls of the elongate sound channel 50 may be formed by an outer surface of the battery cell 41 for a space efficient design. For example, one wall of the elongate sound channel 50 may be formed by one side of the battery cell 41 and the other walls of the elongate sound channel 50 may be formed by one or more inner surfaces of the housing 43. In some examples, the elongate sound channel 50 may be fully incorporated within the housing 43. In some examples, the sound channel 50 may be an enclosed channel having sidewalls formed by surfaces of the housing 43.

The sound path 80 may be shaped or may include features for performing frequency shaping of the sounds to produce a filtered sound output. In some examples, the elongate sound channel 50 may be tapered (e.g., via use of sloped wall 52) so as to increase in height (H) medially along the length (L) of the elongate sound channel 50. In some examples, the elongate sound channel 50 may include one or more curved walls. In some examples, an inlet of the sound channel 50 may be positioned lateral to the battery cell 41 and an outlet 53 of the sound channel 50 may be positioned medial to the battery cell 41. This may provide increased separation between sound input and output ports as compared to conventional canal hearing aid devices. The sloped wall 52, the amount of separation between the sound input and output ports, microstructures formed within the elongate sound channel 50, and/or other features of the elongate sound channel 50 may cause frequency shaping of the sound traveling through the sound channel 50. The frequency shaping may include an increased gain at certain frequencies and/or improved feedback control by increasing the separation between input and output ports. In some examples, the elongate sound channel 50 may be shaped or may include features for selectively amplifying certain frequencies. The elongate sound channel 50 may be at least 4 mm in length. The elongate sound channel 50 may have an average cross sectional area in the range of around 1-2 $mm^2$.

Figure 5:
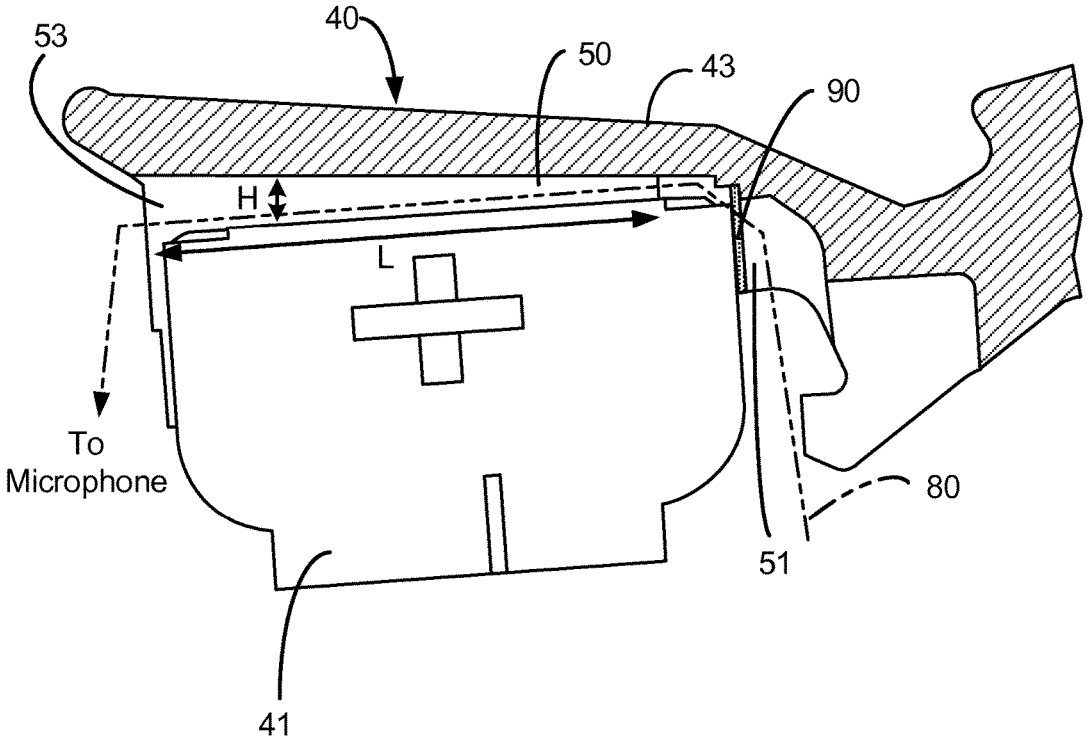
FIG. 5 is a cross-sectional view of a lateral section showing a sound path through an elongate sound channel of the lateral section, according to some examples.

FIG. 5 is a cross-sectional view of a lateral section 40 showing a sound path 80 through an elongate sound channel 50 of the lateral section 40, according to some examples. In some examples, the lateral section 40 may include a barrier 90 (also referred to herein as debris barrier) to prevent or reduce the ingress of water and/or debris into the sound channel, thereby protecting the microphone 71 and/or other internal components of the canal hearing device 100 from being soiled or damaged while allowing air and sounds to pass through. The barrier 90 may be an acoustically transparent membrane, which may be positioned transverse to the sound channel 50. The barrier 90 may be positioned at a lateral end, a medial end, or anywhere along the length (L) of the elongate sound channel. The barrier 90 may be made of a porous membrane to allow air and block water ingress. In some examples, the membrane has pore sizes in the range of about 30 to about 40 microns. In some examples, the barrier 90 may be provided by a mesh or screen. In some examples, the barrier 90 may be provided by alternating microstructures. The alternating microstructures may be provided by a maze arrangement along the length (L) of the elongate sound channel 50. The microstructures may include protrusions within the elongate sound channel 50. In this manner, the sound port system may be configured to allow sound to pass through to the main section 20 when connected thereto while providing selective sound filtering and filtering out debris that can damage durable components within the main section 20, particularly the microphone 71 within. In some examples, the elongate sound channel 50 may include any of hydrophobic, oleophobic, and oleophilic properties to repel debris from the elongate sound channel 50, or to trap the debris. Sound may pass through a sound channel outlet 53 to the microphone 71. Debris in the ear environment can be physiologic or non-physiologic, and may include earwax, oils, water, particles, chlorine, shampoo, hair spray, etc.

Figure 6:
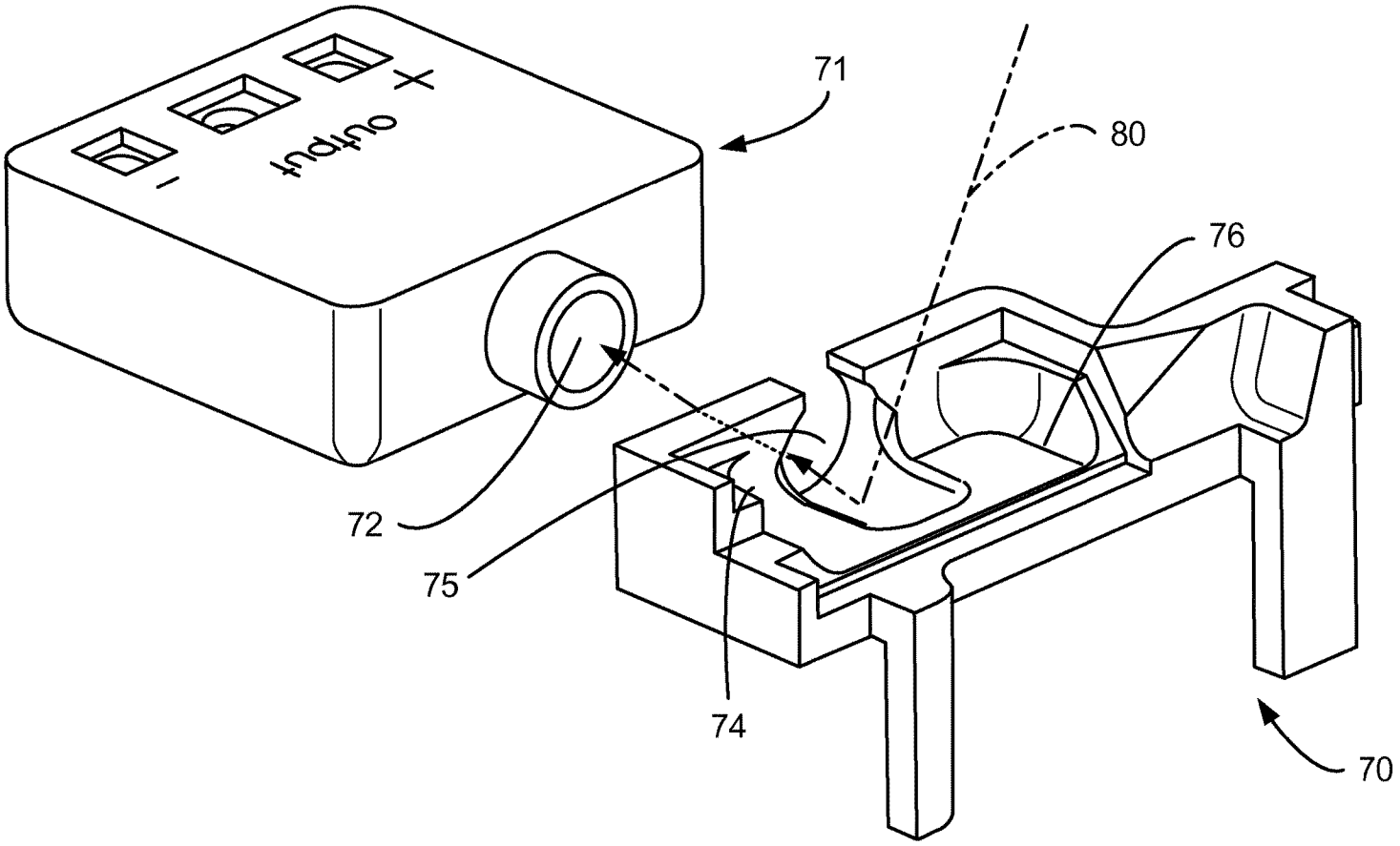
FIG. 6 is an isometric view of a manifold of a canal hearing device showing a sound path through the manifold and the manifold chamber, according to some examples.

FIG. 6 is an isometric view of a manifold of a canal hearing device 100 showing a sound path 80 through the manifold 70, according to some examples. The manifold 70 may provide an acoustic pathway between the lateral section 20 and the microphone 71. The manifold may be formed from plastic, metal, or any other material capable of providing an acoustic pathway. The manifold 70 may include a manifold inlet 74 for receiving sounds from the lateral section 40. A microphone port 72 may be provided to receive sounds from the manifold 70. The manifold 70 may include an acoustically tuned chamber 76 (also referred to herein as "frequency shaping cavity") to provide selective amplification of sounds prior to reaching the microphone 71. In some examples, the manifold 70 may include a frequency shaping cavity 76 to receive a first frequency-shaped output from the elongate sound channel 50. The frequency shaping cavity 76 of the manifold 70 may produce a second frequency-shaped output. The second frequency-shaped output may travel from the manifold 70 to the microphone 71 through a manifold outlet 75.

Figure 7:
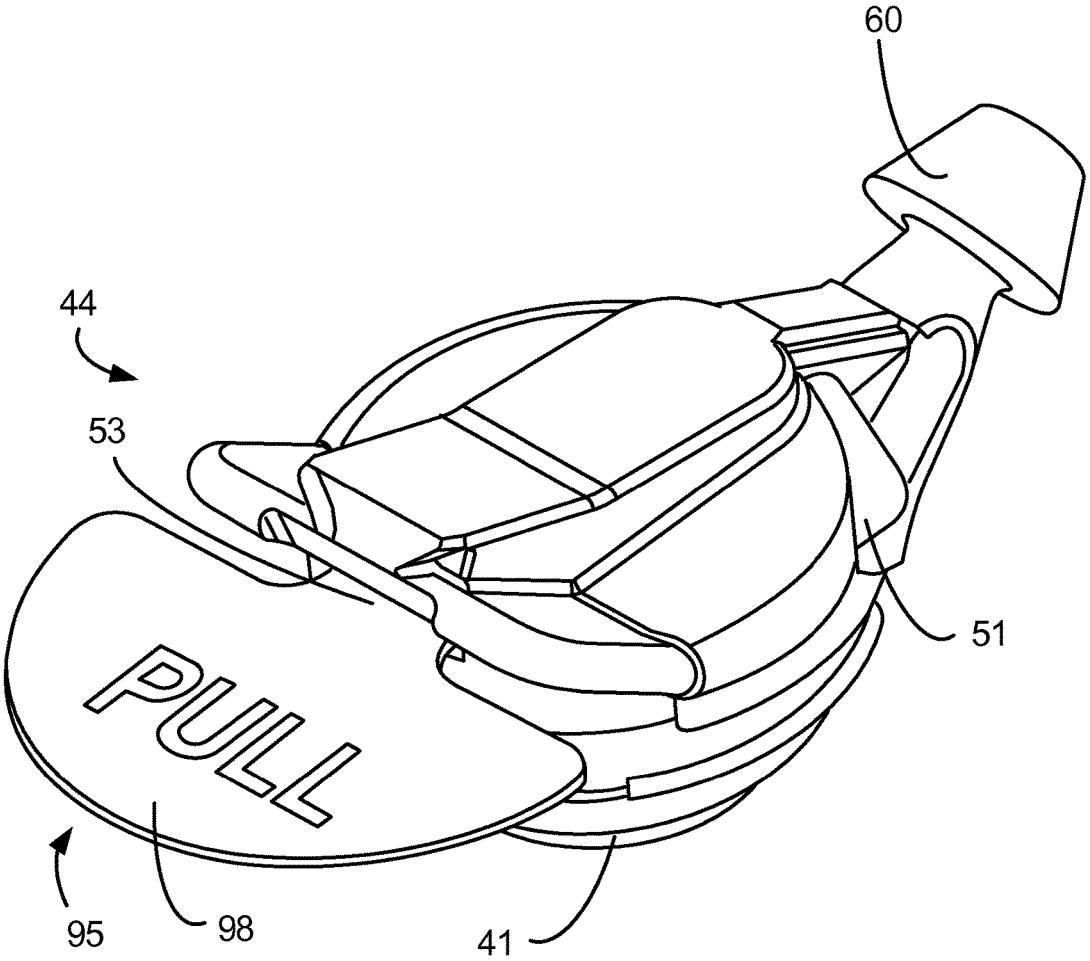
FIG. 7 is an isometric view of a lateral section including a sound channel inlet and an air tab, according to some examples.
Figure 8:
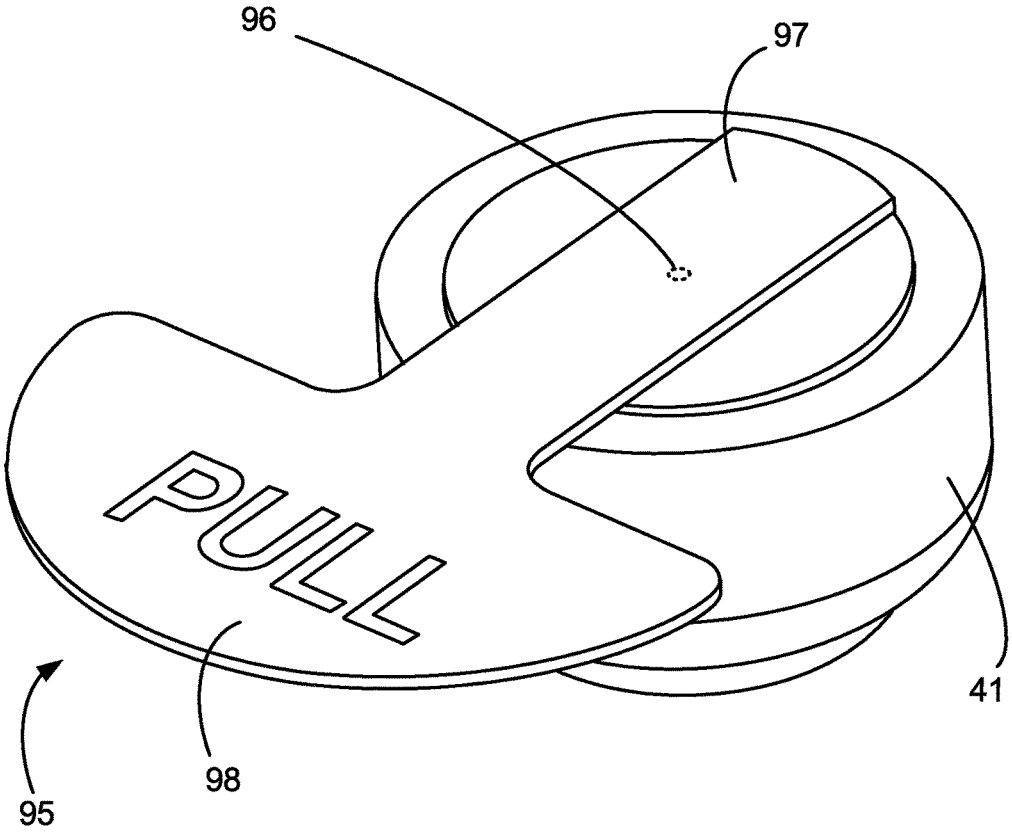
FIG. 8 is an isometric view of an air tab positioned over an air hole of a battery cell, according to some examples.

FIGS. 7 and 8 are views of a battery module 44 and components thereof according to some examples. The battery module 44 may include one or more of the components of lateral module 40 described herein. For example, the battery module 44 may include a sound channel 50 including a sound channel inlet 51 and a sound channel outlet 53. The battery module may include a handle 60. The battery module 44 may include an air tab 95, which may be removably attached to a battery cell 41 such that it blocks or at least partially obstructs an air inlet (e.g., air hole 96) of the battery cell 41. The battery cell 41, e.g., an air zinc battery cell, may be incorporated within the battery module 44, according to some examples. In some examples, the air tab 95 may be placed at least partially inside the elongate sound channel 50 and removed by a pulling force in an outward direction, e.g., a direction generally aligned with a longitudinal direction of the sound channel 50. The air tab 95 may include a first portion 97, which may be attached to the battery cell 41. The air tab 95 may include a second portion 98, which may extend from the sound channel outlet 53. The first portion 97 may be a relatively narrow portion, configured for insertion within the elongate sound channel 50 and the second portion 98 may be a relatively wide portion configured to protrude from the sound channel outlet 53 such that the second portion 98 may be easily grasped and detached from the battery cell 41. The air tab 95 may be formed from laminated paper, or any other material that can be shaped to fit inside the elongate sound channel 50. The air tab 95 may restrict air access to the battery cell 41 and preserve battery cell shelf life prior to activation of the battery cell 41. The air tab 95 may be removed to activate the battery cell 41 prior to use with the canal hearing device 100.

Figure 9:
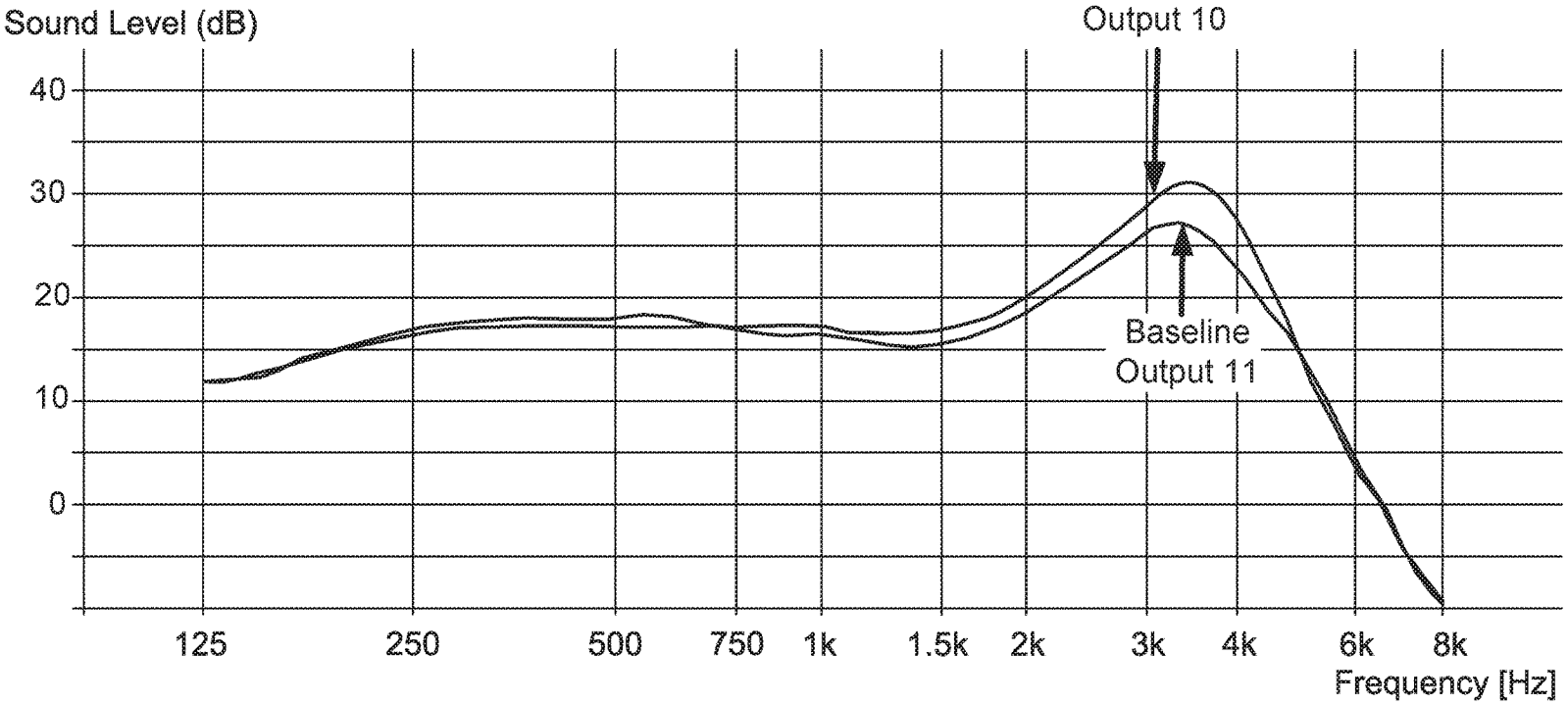
FIG. 9 is a plot of frequency shaping achieved using an elongate sound channel, according to some examples.

FIG. 9 is a representation of a frequency shaping achieved using a sound channel according to some examples herein. The elongate sound channel 50 may provide approximately a 3-6 dB boost at the frequency range of about 3-6 kHz. The elongate sound channel 50 may provide at least 3 dB of gain at an audiometric frequency range. FIG. 9 shows a frequency response produced by a conventional sound port (referred to as baseline output 11) versus a frequency response produced by a sound port system including the elongate sound channel 50 (referred to as sound channel output 10). The baseline output 11 was generally 3-5 dB lower at the peak frequency of about 3.7 kHz compared to the sound channel output 10. In some examples, a conventional sound port is proximate to the microphone port 72 or coupled via a Silicon tube. A first type of the elongate sound channel 50 included an untapered sound channel in which the dimensions of the elongate sound channel 50 are relatively constant along the length of the elongate sound channel 50. The length (L) was 5.9 mm, the width (W) was 2 mm, and the height (H) was 0.6 mm. A second type of elongate sound channel 50 included a tapered sound channel in which the channel height widened along the length of the sound channel to achieve a horn-shaped design. In some examples, the length of the elongate sound channel 50 may be at least 4 mm and the average cross sectional area of the elongate sound channel 50 may be in the range of 1-2 $mm^2$.

Although embodiments of the invention are described herein, variations and modifications of these embodiments may be made, without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A canal hearing device comprising:

a housing configured to accommodate a battery cell at least partially within, the housing comprising an elongate sound channel configured to receive an incoming sound from a sound channel inlet and provide a frequency-shaped sound output at a sound channel outlet, wherein a height of the elongate sound channel is less than a height of the battery cell along an entire length of the of the elongate sound channel, and wherein the frequency-shaped sound output provides at least 3 dB of gain at a frequency within the range of 3-6 kHz; and a microphone;

a speaker for transmitting sound to the eardrum; and a sound port acoustically coupling the frequency-shaped sound output to the microphone.

2. The canal hearing device of claim 1, wherein the elongate sound channel is horn-shaped.

3. The canal hearing device of claim 1, wherein the sound port comprises a manifold configured to acoustically couple the sound channel outlet with the microphone.

4. The canal hearing device of claim 1, further comprising a debris barrier coupled to the elongate sound channel.

5. The canal hearing device of claim 4, wherein the debris barrier comprises any of a mesh, a screen, or a membrane.

6. The canal hearing device of claim 4, wherein the debris barrier comprises alternating microstructures.

7. The canal hearing device of claim 4, wherein the debris barrier is provided by a maze structure within the elongate sound channel.

8. The canal hearing device of claim 1, wherein the elongate sound channel comprises any of hydrophobic, oleophobic, and oleophilic properties.

9. The canal hearing device of claim 1, wherein a partial disengagement of a lateral section of the canal hearing device from a main section of the canal hearing device provides the canal hearing device in an OFF condition.

10. The canal hearing device of claim 1, wherein a lateral section of the canal hearing device is removably coupled to a main section of the canal hearing device.

11. The canal hearing device of claim 1, further comprising the battery cell and wherein one side of the elongate sound channel is at least partially formed by the battery cell.

12. The canal hearing device of claim 1, further comprising the battery cell and wherein the battery cell is integrated into a lateral section of the canal hearing device.

13. The canal hearing device of claim 1, wherein the elongate sound channel is provided at least partially along an inner surface of the housing.

14. The canal hearing device of claim 1, wherein the sound channel inlet is positioned lateral to a cavity configured to accommodate the battery cell therein.

15. The canal hearing device of claim 1, further comprising a handle.

16. The canal hearing device of claim 15, wherein the sound channel inlet is incorporated within the handle.

17. The canal hearing device of claim 16, wherein the sound channel inlet is positioned proximate to a base of the handle.

18. The canal hearing device of claim 1, wherein the elongate sound channel is at least 4 mm in length.

19. The canal hearing device of claim 1, wherein an average cross sectional area of the elongate sound channel is in the range of 1-2 $mm^2$.

20. A canal hearing device comprising:

a battery cell;

a housing configured to accommodate the battery cell at least partially within;

a microphone; and a sound port system comprising an elongate sound channel formed at least partially by an inner surface of the housing, and an incoming sound inlet for receiving incoming sound, wherein the elongate sound channel is configured to provide an increase in gain of the incoming sound of at least 3 dB at a frequency within the range of 3-6 kHz to produce a frequency-shaped output, and wherein the sound port system is configured to couple the frequency-shaped output to the microphone.

21. The canal hearing device of claim 20, wherein the sound port system further comprises a debris barrier.

22. The canal hearing device claim 20 further comprising a handle.

23. The canal hearing device of claim 20, wherein the sound port system is configured to reduce feedback.

24. The canal hearing device of claim 20, wherein the elongate sound channel is at least 4 mm in length.

25. The canal hearing device of claim 20, wherein an average cross sectional area of the elongate sound channel is in the range of 1-2 $mm^2$.

26. A battery module for use with a canal hearing device, the battery module comprising:

a housing;

a battery cell integrated within the battery module;

a microphone; and a sound port system comprising an elongate sound channel formed at least partially by a groove on an inner surface of the housing and an incoming sound inlet, the sound port system configured to receive an incoming sound, wherein the elongate sound channel is configured to perform frequency shaping of the incoming sound to produce a frequency-shaped output which provides at least 3 dB of gain at a frequency within the range of 3-6 kHz, wherein the frequency-shaped output is coupled to the microphone, and wherein the incoming sound inlet is positioned lateral to the battery cell.

27. The battery module of claim 26, wherein the sound port system comprises a debris barrier.

28. The battery module of claim 26, wherein the incoming sound inlet and the elongate sound channel are configured to reduce feedback.

29. A canal hearing device comprising:

a housing;

a battery cell integrated, at least partially, within the housing;

a microphone; and a sound port system comprising an elongate sound channel and an incoming sound inlet positioned lateral to the battery cell, the sound port system configured to receive an incoming sound through the incoming sound inlet, wherein the elongate sound channel is formed by one side of the battery cell and a groove formed on an inner surface of the housing, and wherein the sound channel is configured to amplify the incoming sound by at least 3 dB at a frequency within the range of 3-6 kHz to provide an amplified sound to the microphone.

30. A canal hearing device comprising:

a housing configured to accommodate a battery cell and a microphone at least partially within, the housing comprising a sound channel including a sound channel inlet positioned lateral to the battery cell and a sound channel outlet positioned medial to the battery cell, wherein the sound channel is configured to receive incoming sound from the sound channel inlet, wherein the sound channel is configured to amplify the incoming sound by at least 3 dB at a frequency within the range of 3-6 kHz and transmit the amplified sound to the sound channel outlet for coupling the amplified sound to the microphone.

31. The canal hearing device of claim 30, further comprising an air tab at least partially inserted within the sound channel, wherein the air tab is attached to the battery cell blocking an air inlet of the battery cell, and wherein the air tab is removably attached to the battery cell.

32. The canal hearing device of claim 31, wherein the air tab comprises a first portion attached to the battery cell and a second portion attached to the first portion and extending from the sound channel outlet of the lateral section.

33. The canal hearing device of claim 30, further comprising a debris barrier.

34. The canal hearing device of claim 30, further comprising the battery cell.

* * * * *